US006779861B2

(12) United States Patent
Mori

(10) Patent No.: US 6,779,861 B2
(45) Date of Patent: Aug. 24, 2004

(54) ENHANCED DOT RESOLUTION FOR INKJET PRINTING

(75) Inventor: Ike Mori, San Jose, CA (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/320,865

(22) Filed: Dec. 16, 2002

(65) Prior Publication Data

US 2004/0113962 A1 Jun. 17, 2004

(51) Int. Cl.[7] ..... B41J 2/145
(52) U.S. Cl. ..... 347/12; 347/40
(58) Field of Search ..... 347/9, 12, 13, 347/15, 40, 41, 42, 43; B41J 2/145, 2/15, 2/155

(56) References Cited

U.S. PATENT DOCUMENTS

| | | | | | |
|---|---|---|---|---|---|
| 4,374,388 | A | * | 2/1983 | Heinzl | 347/15 |
| 4,396,924 | A | | 8/1983 | Rosenstock | 347/68 |
| 4,714,934 | A | | 12/1987 | Rogers | 347/107 |
| 4,901,093 | A | | 2/1990 | Ruggiero et al. | 347/70 |
| 4,963,882 | A | | 10/1990 | Hickman | 347/41 |
| 5,216,445 | A | * | 6/1993 | Hirasawa et al. | 347/15 |
| 5,270,728 | A | | 12/1993 | Lund et al. | 347/5 |
| 5,541,625 | A | | 7/1996 | Holstun et al. | 347/5 |
| 5,581,283 | A | | 12/1996 | Rogers | 347/40 |
| 5,594,478 | A | | 1/1997 | Matsubara et al. | 347/41 |
| 5,731,827 | A | | 3/1998 | Mantell et al. | 347/40 |
| 5,880,756 | A | * | 3/1999 | Ishii et al. | 347/40 |
| 5,943,072 | A | * | 8/1999 | Robert et al. | 347/40 |
| 5,946,012 | A | | 8/1999 | Courian et al. | 347/63 |
| 5,966,148 | A | | 10/1999 | Rogers et al. | 347/40 |
| 5,984,455 | A | * | 11/1999 | Anderson | 347/47 |
| 6,084,609 | A | * | 7/2000 | Manini et al. | 347/40 |
| 6,099,108 | A | * | 8/2000 | Weber et al. | 347/43 |
| 6,145,980 | A | * | 11/2000 | Wang | 347/104 |
| 6,179,408 | B1 | | 1/2001 | Rogers et al. | 347/40 |

FOREIGN PATENT DOCUMENTS

| | | |
|---|---|---|
| EP | 623 473 | 11/1994 |
| JP | 10-315463 | 12/1998 |

* cited by examiner

*Primary Examiner*—Juanita Stephens
*Assistant Examiner*—Blaise Mouttet
(74) *Attorney, Agent, or Firm*—David J. Arthur

(57) ABSTRACT

An ink jet printer includes a printhead and a print medium that move relative to one another in a printing direction. The printhead includes a plurality of ink delivery channels, and an ink outlet corresponding to each of the ink delivery channels. Each ink outlet includes at least two ink orifices offset from one another in a direction transverse to the printing direction, so that as the printhead traverses a print medium, control signals to the printhead can deposit two drops from each delivery channel, which drops are offset in the transverse direction, thereby permitting the use of smaller ink drops and a higher apparent print resolution for the image deposited on the print medium than the resolution of the print control signals in the transverse direction.

24 Claims, 11 Drawing Sheets

ENHANCED DOT RESOLUTION FOR INKJET PRINTING

BACKGROUND

The present invention relates to printing images on a print medium by depositing drops of a marking material, such as liquid ink.

Direct marking printers deposit a marking material, such as ink, onto a print medium, such as paper, to form images on the print medium. A common direct marking printer is the ink jet printer, which ejects drops of ink from an array of orifices on a printhead onto the print medium. The ink drops can be ejected from the printhead using thermal energy to form a gas or air bubble behind the ink drop in an orifice nozzle, or using electrical signals to alter the shape of piezoelectric material positioned to force a drop out of the orifice nozzle. Although the following description focuses on the use of piezoelectric drop ejection technology, those skilled in the art will recognize that the principles described are also applicable to other printing technologies, such as thermal ink jet.

A common construction of an ink jet printer includes a printhead that moves in a printing direction across the width of the print medium, depositing a set of ink drops on the print medium as the printhead moves to form an image swath on the print medium. After the printhead traverses the width of the print medium, the printer moves the print medium in a media travel direction, so that the printhead can again traverse the print medium and deposit another set of ink drops to form an additional image swath. Another construction of an ink jet printer includes a stationary printhead that extends across the full width of the print medium. The printhead deposits ink drops on the print medium as the print medium moves past the printhead.

Ink jet printheads are constructed to deposit ink drops at one predetermined density (dots per inch (dpi)) on the print medium in the printing direction, and also to deposit ink drops at another predetermined density (dots per inch) in a transverse direction, perpendicular to the printing direction. The dot density in the printing direction may be the same as, or different from the dot density in the transverse direction. Typically, the lower the ink drop density (the fewer dots per inch), the larger each dot is, to ensure full coverage of the print medium. The greater the dot density (more dots per inch), the smaller each dot is. Smaller, higher density dots tend to provide the edges of printed images with greater apparent sharpness. However, higher density printheads are more complex to manufacture, and controlling a larger number of ink ejectors to produce the greater number of ink drops requires a larger amount of data to be processed and transferred to the printhead.

SUMMARY

An ink jet printer in accordance with the present invention includes a printhead and media movable with respect to one another in a printing direction. The printhead includes a plurality of ink outlets, each comprising two or more ink orifices, so that each ink outlet simultaneously ejects a set of at least two ink drops. The printhead additionally includes a plurality of ink ejectors for ejecting the ink drop sets from the ink outlets onto the print medium. Each ink ejector ejects one ink drop set from a multi-orifice ink outlet. The drops of each ink drop set are offset from one another in a transverse direction (perpendicular to the printing direction) by a transverse direction dot offset. A controller causes the printhead to deposit the ink drop sets with a printing direction dot set spacing (spacing between separate dot sets) that is approximately equal to the individual dot offset (between dots of a single dot set) in the transverse direction, reducing the number of control signals required to deposit dots. The printhead deposits small ink drops, so that the printhead can deposit the ink drops at a high frequency. The high frequency of ink drop deposit and small drop size permits high print resolution in the printing direction. The offset of the ink drops of each ink drop set in the transverse direction fills out the resulting printed image.

An example of a printhead for an ink jet printer in accordance with the present invention includes a printhead body having a printing direction and a transverse direction, and a plurality of ink delivery channels, and a plurality of ink outlets. Each ink outlet comprises a multi-orifice outlet from a corresponding particular one of the ink delivery channels, and each ink outlet comprises at least first and second ink orifices. The second ink orifice of each multi-orifice ink outlet is offset from the first ink orifice of that ink outlet in the transverse direction. The printhead additionally includes a plurality of ink ejectors. Each ink ejector simultaneously ejects from the first and second ink orifices of a corresponding particular ink outlet first and second ink drops.

A method of printing an image includes moving an ink jet printhead and a print medium relative to one another in a printing direction while using a single control signal to eject from a first multi-orifice ink outlet of the printhead a plurality of first ink drop sets and using a separate single control signal to eject from a second multi-orifice ink outlet a plurality of second ink drop sets. Ejecting from the first multi-orifice ink outlet each first ink drop set includes simultaneously ejecting a first set of ink drops that are offset from one another in a transverse direction, perpendicular to the printing direction, to form offset ink dot sets on the print medium, and ejecting from the second multi-orifice ink outlet each second ink drop set includes simultaneously ejecting a second set of ink drops that are offset from one another in the transverse direction to form offset ink dot sets on the print medium. The ink dot sets from the first multi-orifice ink outlet are spaced from one another by a printing direction dot set spacing. The ink dot sets from the second multi-orifice ink outlet are also spaced from one another by the printing direction dot set spacing. The ink dot sets from the first multi-orifice ink outlet are spaced from the ink dot sets from the second multi-orifice ink outlet in the transverse direction by a transverse dot set spacing that is greater than the printing direction dot set spacing.

THE FIGURES

DETAILED DESCRIPTION

Figure 1:
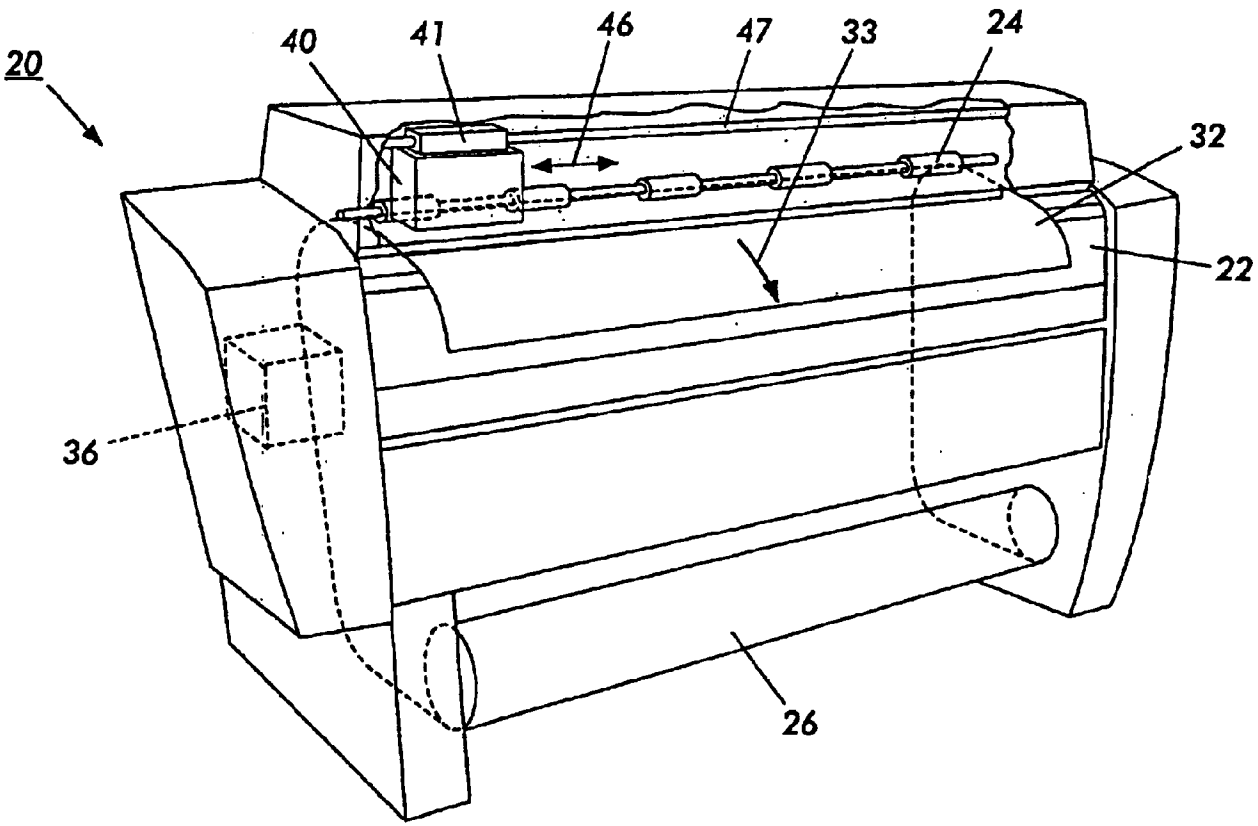
FIG. 1 is a perspective view (partially in cross-section) of a portion of an ink jet printer incorporating one implementation of the present invention.

FIG. 1 shows an ink jet printer 20. The particular printer illustrated in FIG. 1 is a wide format printer suitable for printing on print media greater than about 36 inches in width. Those skilled in the art will recognize that the principles described herein are also applicable to other sizes of printers. The printer includes a housing 22 containing a media transport mechanism, such as powered rollers 24, that moves a print medium 32 in a media travel direction 33. Those skilled in the art are familiar with such media transport mechanisms, and will recognize that numerous other mechanisms are also suitable for moving the print medium. In one example, the media transport mechanism draws the print medium from a supply roll 26. One or more printheads 40 are contained in the housing 22 for depositing ink drops onto the print medium 32 as the printhead and the print medium move relative to one another. In the illustrated embodiment, the printhead 40 is attached to a carriage 41 that is moveable in a printing direction 46 along a printhead carriage path 47 that traverses the width of the print medium 32. A controller 36 is configured or programmed to control the operations of the printer, including the movement of the printhead, the ejection of ink drops from the printhead, and movement of the print medium.

Figure 2:
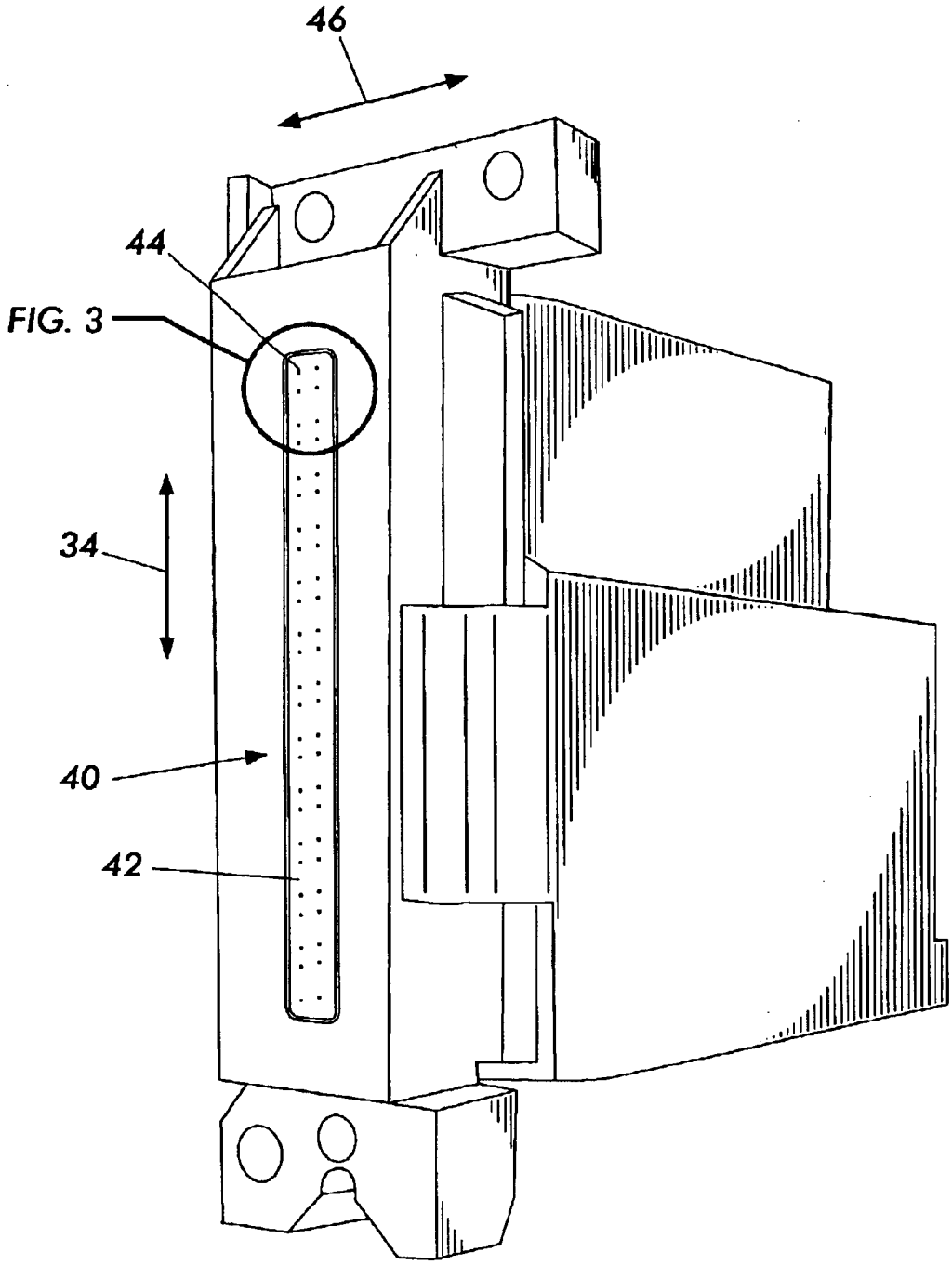
FIG. 2 is a perspective view of an ink jet printhead for the printer of FIG. 1.

FIG. 2 shows a printhead 40 used in the printer of FIG. 1. A printer for producing color images will have several such printheads. Ordinarily, one printhead prints only a single color. Therefore, the printer includes at least one printhead for each color to be printed.

The printhead includes an orifice plate 42 having a plurality of ink outlets 44. Ink ejectors positioned behind the orifice plate cause ink droplets to be ejected from the ink outlets in the orifice plate. The printhead is positioned within the housing 22 so that the ink outlets 44 of the orifice plate. 42 are directed toward the print medium 32 (FIG. 1) during a printing operation. The printhead deposits ink drops onto the print medium as the printhead and the print medium move relative to one another in the printing direction 46. In the exemplary printer illustrated in FIG. 1, the printhead 40 is moveable in the printing direction 46 within the printer housing. In embodiments in which the printhead moves during a printing operation, after the printhead deposits a swath of the image to be printhead, the media transport mechanism 24 moves the medium in the media travel direction 33 substantially perpendicular to the printing direction. The media transport mechanism moves the medium approximately the width of a printing swath. The printhead then again traverses the media in the printing direction 46, printing another swath of the image. In other implementations, the printhead 40 extends across the entire width of the print medium, and remains stationary during a printing operation, as the media transport mechanism moves the print medium in the printing direction. In such implementations, the printhead 40 shown in FIG. 2 is mounted in the printer housing so that the printing direction 46 and the media travel direction are the same.

The particular printhead illustrated in FIG. 2 includes ink outlets arranged generally in columns oriented in a transverse direction 34, generally perpendicular to the printing direction. In an embodiment in which the printhead moves during a printing operation (FIG. 1), the transverse direction 34 is substantially the same as the media travel direction 33. In an embodiment in which the printhead remains stationary during a printing operation (while the media moves), the transverse direction 34 is substantially perpendicular to the media travel direction.

Figure 3:
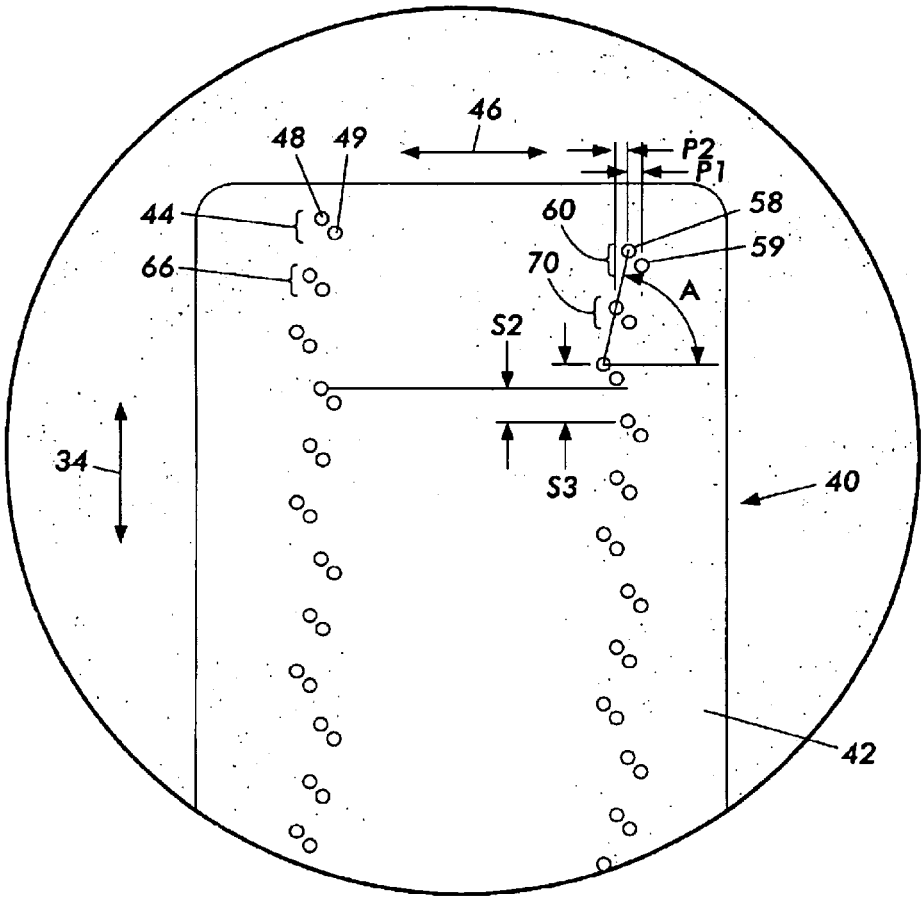
FIG. 3 is an enlarged view of a portion of the orifice plate of the printhead shown in FIG. 2.
Figure 4:
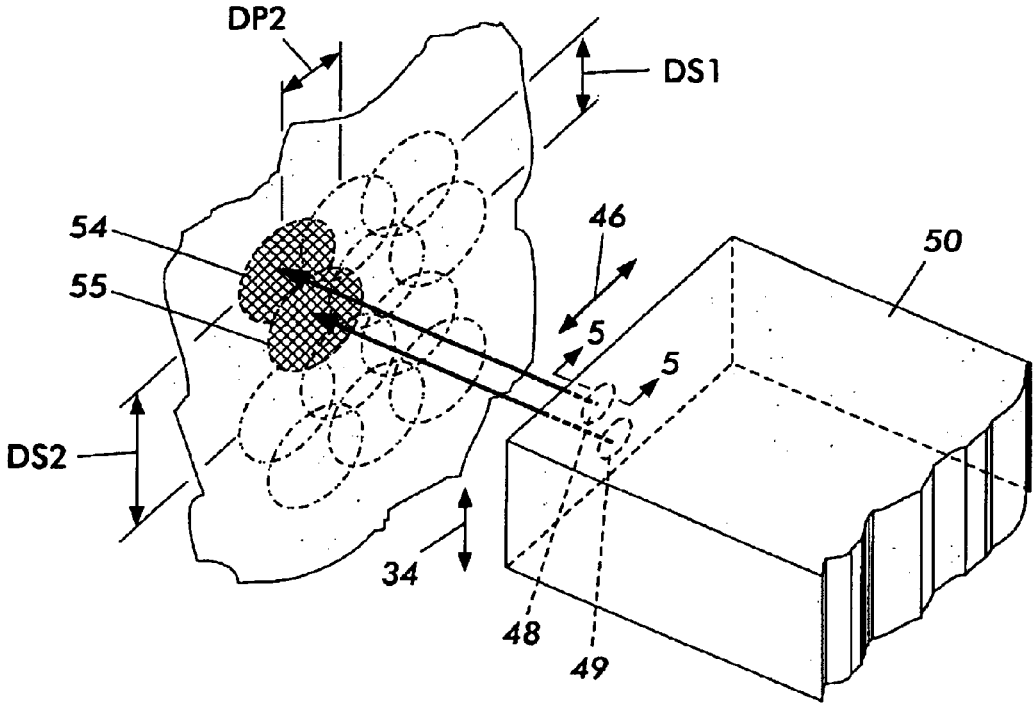
FIG. 4 is a conceptual view of an ink outlet depositing ink drops on a print medium.
Figure 5:
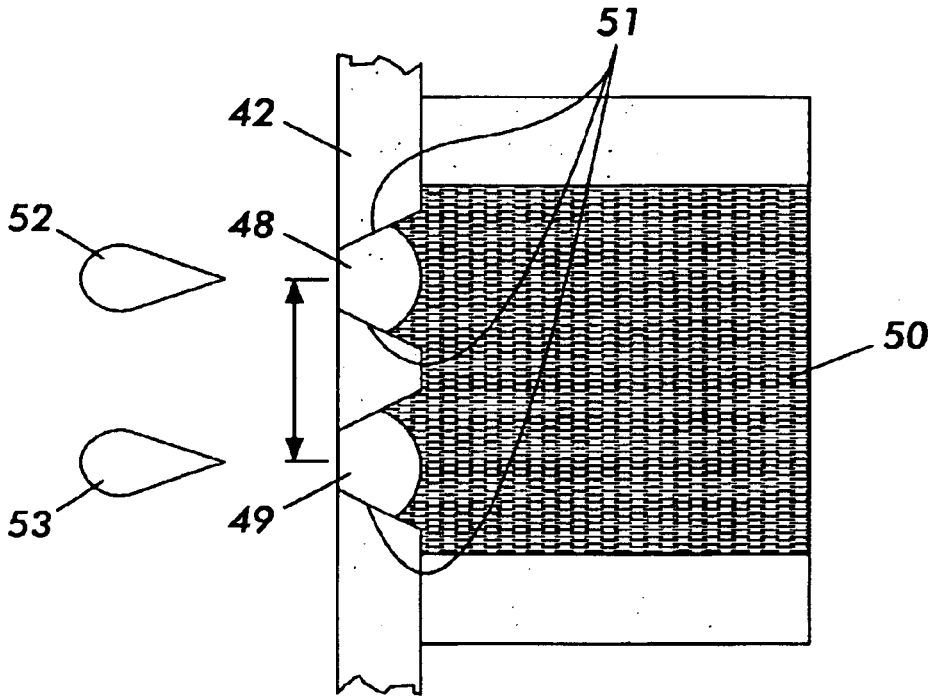
FIG. 5 is a cross sectional view of an ink delivery channel and ink orifices of one of the ink outlets of the printhead shown in FIG. 2.

Referring to the close-up view of a portion of the orifice plate shown in FIG. 3, each ink outlet 44 is formed of at least two ink orifices 48, 49. As shown in FIGS. 4 and 5, each multi-orifice ink outlet 44 is supplied by one ink feed channel 50. The ink orifices 48, 49 forming a multi-orifice ink outlet from a corresponding ink feed channel are offset from one another in the printing direction 46 by a printing direction orifice offset P1 (FIG. 6), and in the transverse direction by a transverse direction orifice offset S1. The printing direction orifice offset P1 and the distances between corresponding portions of the respective orifices, such as center to center (shown) or leading edge to leading edge.

Figure 6:
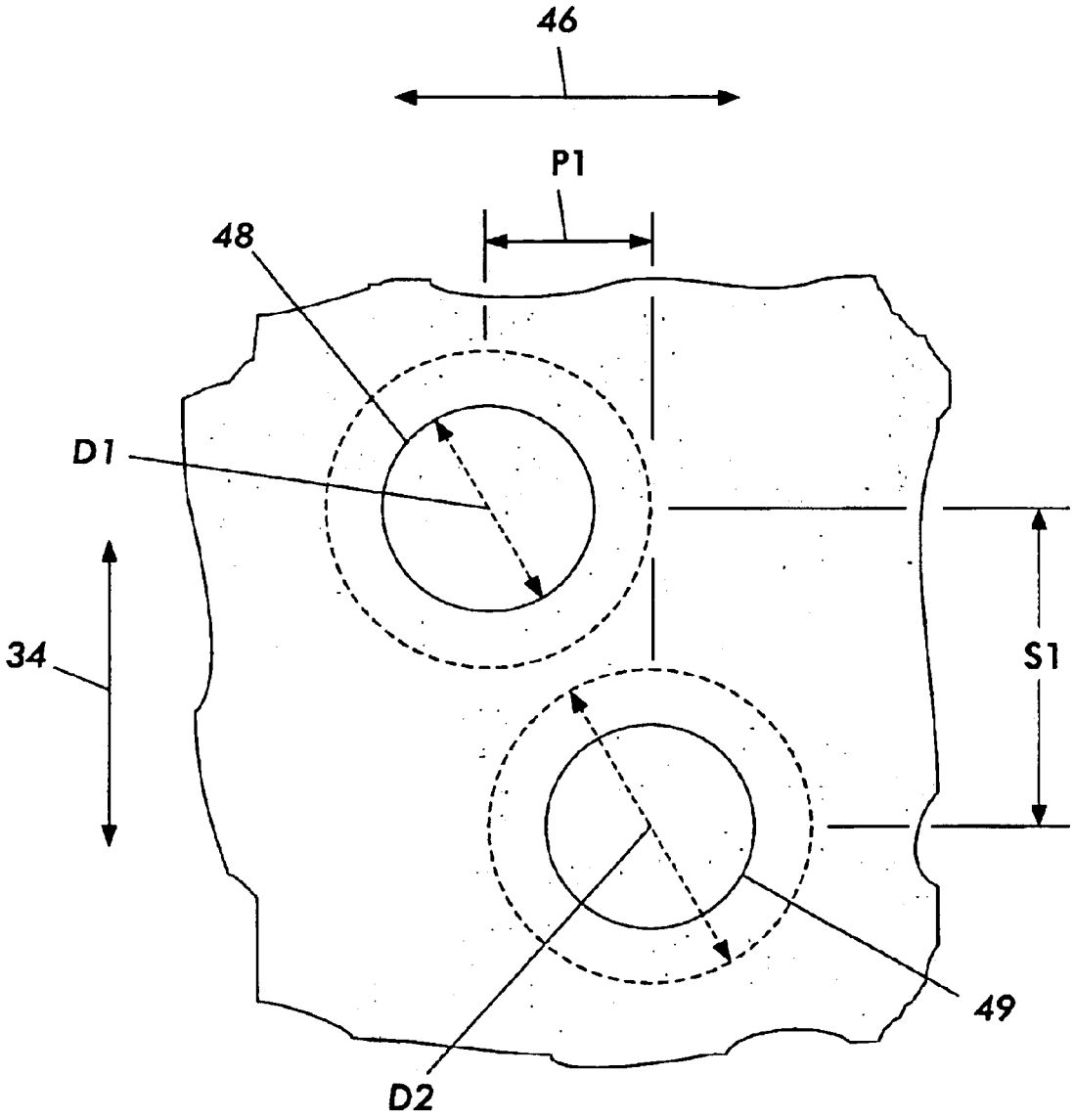
FIG. 6 is a view of one of the ink outlets of the printhead of FIGS. 2 and 3.

As shown in FIGS. 5 and 6, each ink orifice 48, 49 of the multi-orifice ink outlet 44 has a front orifice diameter D1 at the outer surface of the orifice plate that is smaller than the rear orifice diameter D2 at the inner side of the orifice plate, adjacent the ink feed channel. The diameter of the orifice and the thickness of the orifice plate affect the size of the ink droplet ejected from that orifice. For example, an orifice with a front orifice diameter D1 of 20 um and a rear orifice diameter D2 of 35 um through an orifice plate with a thickness of approximately 30 um produces an ink droplet of approximately 7 picoliters. An orifice with a front orifice diameter of approximately 25 um and a rear orifice diameter of approximately 40 um produces a droplet of approximately 10 picoliters. An orifice having a front orifice diameter of 30 um and a rear orifice diameter of approximately 45 um produces an ink droplet of approximately 15 picoliters.

Piezoelectric ink ejectors 51 built into or adjacent the orifice plate simultaneously eject a drop of ink 52, 53 from each of the ink orifices 48, 49 of a multi-orifice ink outlet 44 from a particular ink delivery channel 50. The ink drops 52, 53 are ejected in trajectories that are substantially parallel one another and substantially perpendicular to the plane of the orifice plate. The piezoelectric ink ejectors for the two orifices 48, 49 forming one multi-orifice ink outlet are driven by the same ejection control signal for that ink outlet, so that each two orifice ink outlet produces a set of two simultaneous ink drops. The piezoelectric ink ejectors are of a type familiar to those skilled in the art.

As the printhead 40 and the print medium 32 move relative one another in the printing direction 46, the ink ejectors eject pairs of ink drops from the orifices of the multi-orifice ink outlet to form pairs of dots 54, 55 on the print medium, as. seen in FIG. 4. The dots 54, 55 from a single firing of one multi-orifice ink outlet are offset in the printing direction by a printing direction dot offset DP1 (see FIG. 7) governed by the offset in the printing direction (P1 in FIG. 6) of the orifices of the multi-orifice ink outlet. Generally, the printing direction dot offset DP1 is approximately the same as the printing direction orifice offset P1. Printing direction dot spacing DP2 in the printing direction 46 between dot pairs deposited by successive firings of the ink ejectors of the ink outlet 44 is governed by a combination of the relative speed of the printhead and print medium in the printing direction 46, and the firing frequency of the ink ejectors for that particular ink outlet. In a moving printhead implementation, as the printhead moves in the printing direction 46 at a predetermined travel speed, the printer controller causes the piezoelectric ink ejectors to fire at a predetermined firing rate to deposit dot sets on the print medium at a predetermined dot set spacing in the printing direction. In a stationary printhead implementation, as the media moves in the printing direction 46 past the printhead at a predetermined travel speed, the printer controller causes the ink ejectors to fire at a predetermined firing rate to deposit dot sets on the predetermined dot set spacing in the printing direction. the faster the ink ejectors can eject dot sets as the printhead and print medium move relative to one another during a printing operation, the greater the potential dot density on the print medium in the printing direction.

The transverse direction orifice offset S1 of the two orifices 48, 49 of the ink outlet 44 causes the dots 54, 55 to be offset in the transverse direction 34 by a transverse dot offset DS1. The transverse dot offset DS1 is approximately equal to the transverse direction orifice offset S1 of the orifices 48, 49.

Figure 7:
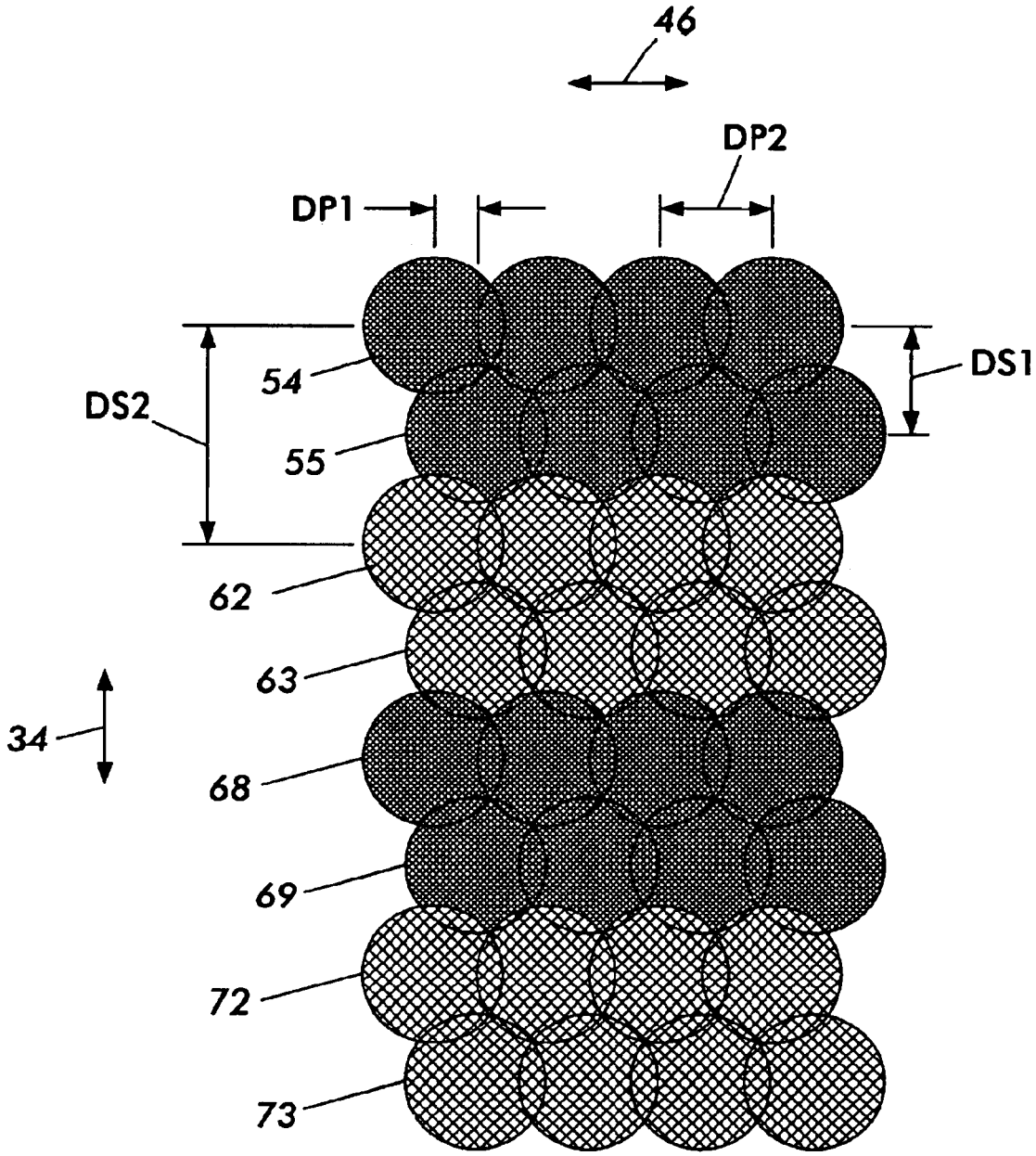
FIG. 7 is a conceptual illustration of a pattern of ink dots deposited by the printhead of FIGS. 2 and 3.

Multiple ink outlets on the printhead, offset in the transverse direction from one another by a transverse direction outlet spacing S2, deposit additional dot sets on the print medium. The additional dot sets are offset in the transverse direction by a transverse direction dot set spacing DS2, to produce a swath of the image to be printed. Referring to the ink outlet pattern of FIG. 3 and the exemplary ink dot pattern of FIG. 7, ink drops from the two orifices 48, 49 of one ink outlet 44 produce one row of dot pairs 54, 55 in the printing direction. Ink drops from the two orifices 58, 59 of a second ink outlet 60, offset in the transverse direction from the first ink outlet by a transverse direction outlet spacing S2 (FIG. 3), produce a second row of dot pairs 62, 63. The second row of dot pairs is offset in the transverse direction from the first row of dot pairs by the transverse direction dot set spacing DS2. Ink drops from the two orifices of a third ink outlet 66 produce a third row of dot pairs 68, 69. And, ink drops from the two orifices of a fourth ink outlet 70 produce a fourth row of dot pairs 72, 73. Those skilled in the art will recognize that the printhead includes a very large number of such ink outlets offset in the transverse direction. The different cross-hatching patterns used in the illustration of FIG. 7 are to aid in distinguishing ink drop sets deposited by different ink outlets, and do not necessarily indicate different colors of ink dots. As noted above, the multi-orifice ink outlet 44 is supplied by one ink feed channel 50. The adjacent multi-orifice ink outlet 66 is supplied by a separate ink feed channel 67. The multi-orifice ink outlets 60, 70 are supplied by separate ink feed channels 61, 71.

The printing direction orifice offset P1 (FIG. 6) causes the two dots produced by the drops that are ejected from the orifices of a single ink outlet to be offset by the printing direction dot offset DP1. The printing direction dot offset DP1 (the offset between the dots from the same ejection from one multi-orifice ink outlet) is less than the printing direction dot set spacing DP2 (the spacing between dot pairs produced by successive ejections from the same multi-orifice ink outlet). In particular, the printing direction dot offset DP1 is approximately one half the printing direction dot set spacing DP2. For example, a printing direction dot set spacing DP2 of approximately 1/720 inch (35.2 um) and a printing direction dot offset DP1 of 1/1440 inch (17.6 um) produces a dot density in the printing direction 46 of approximately 720 DP1 for dots produced by each orifice. The printing direction dot offset DP1 helps to ensure complete color fill as the ink outlet deposits a series of dot pairs.

The transverse direction dot set spacing DS2 between dot sets deposited by different multi-orifice ink outlets 44, 60 in the transverse direction is greater than the printing direction dot set spacing DP2. In particular, the transverse direction dot set spacing DS2 is approximately twice the printing direction dot set spacing DP2. The transverse direction orifice offset between ink orifices 48, 49 of a one multi-orifice ink outlet 44 is approximately sufficient that the two dots produced by the ink drops from the two orifices of the single outlet fill slightly less than twice the space that one of the dots alone fills in the transverse direction. The dots overlap slightly in the transverse direction to ensure complete color fill. For example, the two dots produced by the two orifices of a single ink outlet may have a transverse direction dot offset of 1/720 inch (35.2 um). Other ink outlets on the orifice plate are arranged so that the ink outlet designed to produce an adjacent pair of ink dots produces an adjacent pair of ink dots that have a transverse direction dot set spacing DP2 of 1/360 inch (70.5 um).

References above to "offset" and "spacing" pertain to distances between corresponding portions of the orifices or dots. The terms are applicable whether or not the orifices or dots overlap.

Ejecting small droplets from each orifice allows the printhead to eject ink droplets at a higher frequency than is possible with larger droplets. This permits a higher resolution of printing in the printing direction. Ejecting multiple droplets per channel, with the orifices offset in the transverse direction, improves ink coverage of the media without having to increase the ink ejector density. Thus, using multiple orifices per ink feed channel allows the printer to form an image with a higher apparent resolution than the printhead would otherwise provide.

As noted above, the printhead shown in FIGS. 2 and 3 has ink outlets arranged in two columns oriented in the transverse direction 34. The columns of ink outlets are spaced from one another in the printing direction 46. The ink outlets of the two columns are staggered in the transverse direction so that dot sets from the ink outlets of one column interleave with dot sets from the outlets of the other column, as the printhead deposits ink drops as the printhead and the print medium move relative to one another in the printing direction. The spacing in the transverse direction between ink outlets of one column is twice the overall printhead transverse direction outlet spacing.

The ink outlets of each column are spaced by a printing direction spacing P2, so that they are arranged at an angle A other than perpendicular with respect to the printing direction 46. Thus, as the printhead traverses the print medium in the printing direction, adjacent ink outlets in each column can be fired at slightly offset times to produce a vertical column of dots on the print medium. In the particular implementation illustrated, the ink outlets are arranged at an angle with respect to the printing direction of between 75 degrees and 85 degrees.

In the particular implementation illustrated, the ink outlets of each column are arranged in groups of three. To produce a vertical line of dots, every third ink outlet in the column is fired simultaneously, followed shortly by the simultaneous firing of the second ink outlet of each group of three, followed thereafter by the simultaneous firing of the third outlet of each group of three ink outlets. In an exemplary implementation, each orifice 48, 49, 58, 59 ejects an ink drop at a frequency of approximately 16 kHz as the printhead travels in the printing direction 46 at a speed of approximately 500 mm/sec. The printing direction spacing P2 between an orifice 58 of one multi-orifice outlet 60 and the corresponding orifice of the multi-orifice outlet 70 of an adjacent channel is 31.2 um. Thus, the angle A is approximately 77.5. Those skilled in the art will recognize that different angles are appropriate for different frequencies of ink drop ejection, and different relative speeds of the printhead and the print medium during a printing operation.

Figure 8:
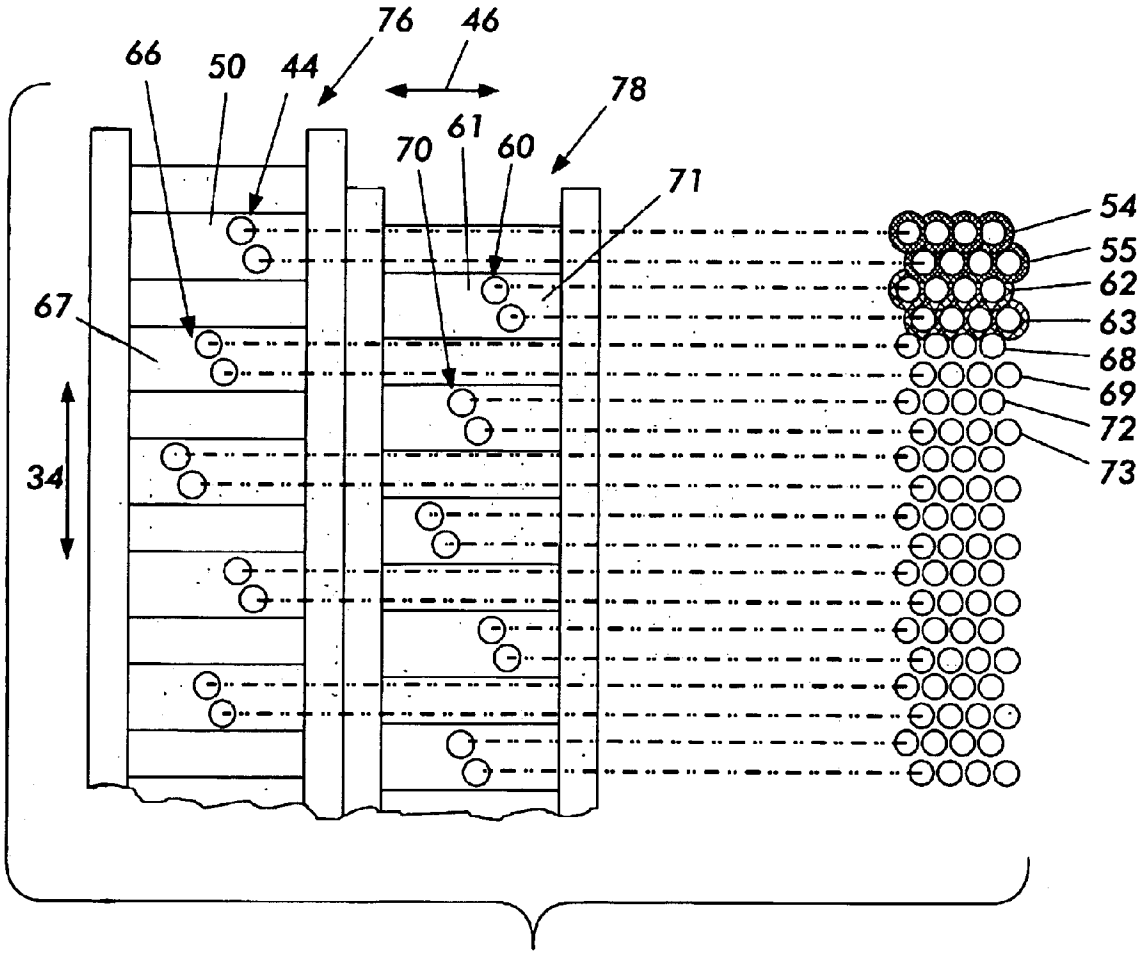
FIG. 8 is a conceptual illustration of the correlation between ink orifices of printhead of FIGS. 2 and 3, and dots deposited on a print medium from such ink orifices.

FIG. 8 shows a conceptual view of the printhead of FIGS. 2 and 3, containing an array of ink outlets 44, 60, 66, 70, each comprising a pair of ink orifices, and the corresponding dot pattern 54, 55, 62, 63, 68, 69, 72, 73 such an array of ink outlets forms on a print medium. The conceptual illustration of FIG. 8 shows the ink orifices of the multi-orifice ink outlets 44, 60, 66, 70 superimposed on the corresponding ink feed channels 50, 61, 67, 71, with a conceptual illustration of the piezoelectric type inkjet head. The covering orifice plate is not shown. Each column of ink outlets and their corresponding ink feed channels is formed as a linear piezoelectric ink jet printhead 76, 78. The two printheads 76, 78 abut one another along a common wall. The printheads 76, 78 are arranged so that the ink outlets 44, 66 of one ink jet printhead 76 are staggered in the transverse direction 34 with respect to the ink outlets 60, 70 of the second printhead 78. The two printheads 76, 78 can share a common wall for simplified electrical connections. Adjacent ink outlets 44, 60 in a single outlet column are spaced at twice the overall ink outlet spacing for the printhead, so that the ink outlets of each column deposit alternating pairs of ink dots. Thus, for the printhead to place dot pairs with a transverse dot pair spacing of 1/360 inch (35.2 um), the transverse direction spacing of the corresponding orifices of adjacent ink outlets 44, 60 in a single ink outlet column is 1/180 inch (141.0 um).

To print a swath of color on the print medium, the printer controller 36 (FIG. 1) selectively directs individual ejection signals to the ink ejectors of selected ones of the ink outlets 44, 60, 66, 70 of the printhead as the printhead and the print medium move relative one another in the printing direction. In an example, the printhead traverses the print medium in the printing direction. The ejection signals cause the ink ejectors to eject ink drop sets from the selected ink outlets. The printer controller controls both the printhead travel speed and the ink ejector firing rate to deposit pairs of ink drops at a desired printing direction dot set spacing DP2 in the printing direction. In an exemplary implementation, the printer controller ejects ink drops from the two orifices of the ink outlet 44 to provide printing direction dot pair spacing DP2 of 1/1720 inch (35.2 um) for the dot pairs 54, 55. The printer controller causes the ink outlet 60 to eject a pair of ink drops so that the dots 62, 63 are spaced by the transverse direction dot pair spacing DS2 in the transverse direction from the dots 54, 55 deposited by the first ink outlet 44. The printer controller causes the ink outlet 66 to eject a pair of ink drops so that the dots 68, 69 are spaced by the transverse direction dot pair spacing DS2 in the transverse direction from the dots 62, 63 deposited by the first ink outlet 44. Each orifice ejects an ink drop 52, 53 of approximately 7–12 picoliters (pl). When the ink ejectors eject approximately 20,000 ink drop pairs per second, the printhead can traverse the print medium at a printhead speed of approximately 28 inches per second (71.1 cm per second).

In the illustrated implementation, the transverse direction dot pair spacing DS2 is different than the printing direction dot pair spacing DP2. The transverse direction dot pair spacing DS2 is greater than the printing direction dot pair spacing DP2. In particular, the transverse direction dot pair spacing DS2 is twice the printing direction dot pair spacing DP2. Thus, a greater amount of data is provided to the printhead with respect to the placement of ink dots in the printing direction than to the placement of ink dots in the transverse direction.

In an implementation in which the printhead traverses the print medium in the printing direction while depositing ink dots, after the printer has deposited a swath of ink dots, the printer controller causes the printer's media transport mechanism to advance the print medium in the media travel direction 33 (which is the same as the transverse direction 34) by an amount that is typically approximately equal to the length of the printhead in the media travel direction. The printhead then traverses the print medium again, depositing ink drops to form an additional swath of the image. In accordance with the printer and printhead described above, the controller provides control signals to each of the ink ejectors to eject selected pairs of ink drops from each selected ink outlet as the printhead travels in the printing direction. Because each activation of a set of ink ejectors at each ink outlet produces two drops of ink, which produce two dots of ink on the print medium, offset in the transverse direction, the printhead controller therefore need supply only half the number of ejector control signals that would otherwise be required for the same number of dots in the transverse direction.

Figure 9:
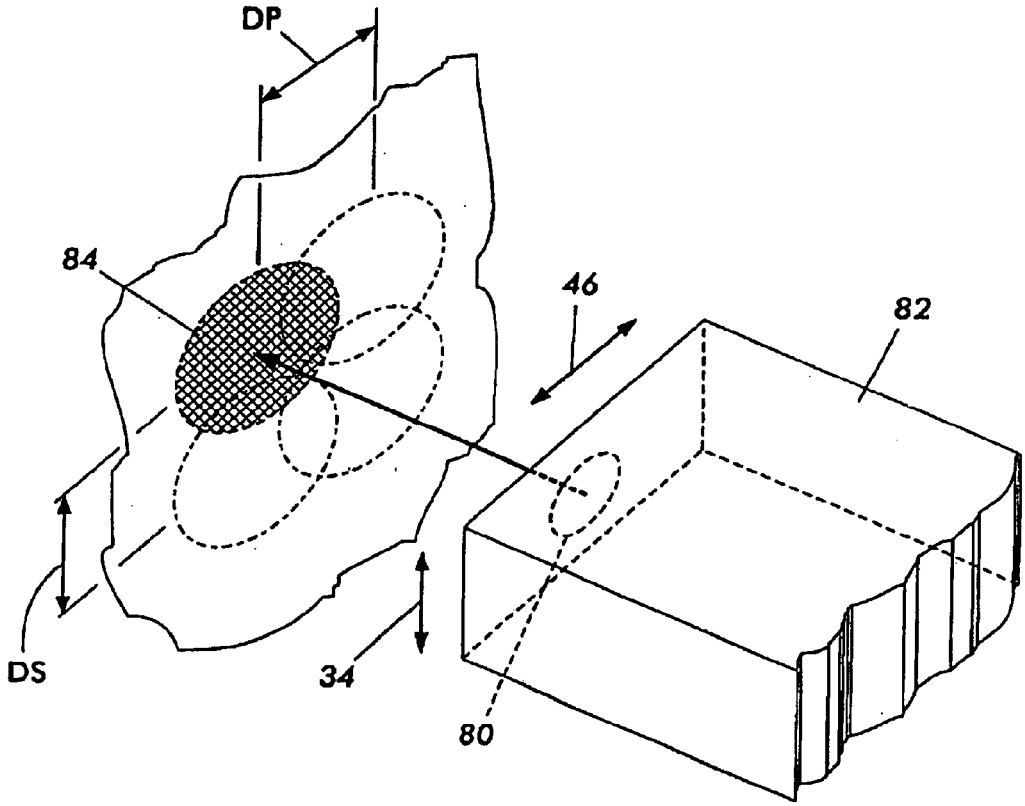
FIG. 9 PRIOR ART
FIG. 9 is a conceptual illustration of an ink outlet of the prior art depositing ink drops on a print medium.

For comparison, FIG. 9 shows a single orifice ink outlet 80 leading from a ink feed channel 82 in an ink jet printhead. For each ejection signal supplied to the ink outlet, the single orifice produces a single ink drop that becomes a single ink dot 84 on the print medium. As the printhead moves in the printing direction 46, successive ejections of ink drops from that same ink orifice 80 produce a row of ink dots, spaced by a printing direction dot spacing DP. Additional ink outlets, identical to the ink outlet 80, arranged in the transverse direction 34, produce additional rows of ink dots spaced in the transverse direction by a transverse direction dot spacing DS.

Figure 10:
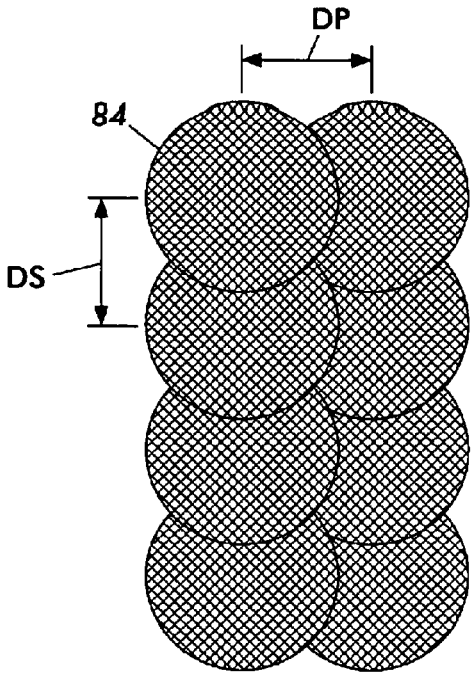
FIG. 10 is a conceptual illustration of a pattern of dots deposited by a printer with a printhead having the ink outlets shown in FIG. 9.
Figure 11:
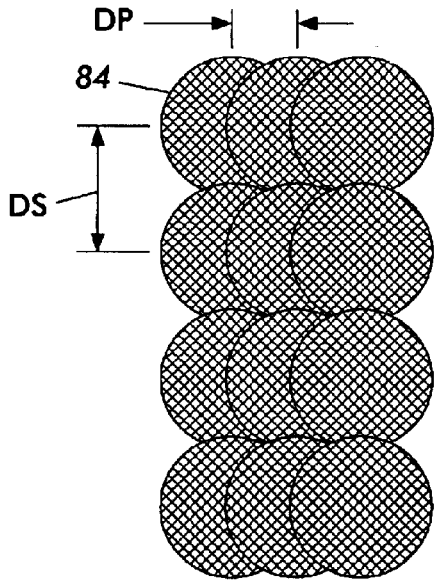
FIG. 11 is a conceptual illustration of a pattern of dots deposited by a printer with a printhead having the ink outlets shown in FIG. 9 and controlled in a different manner.
Figure 12:
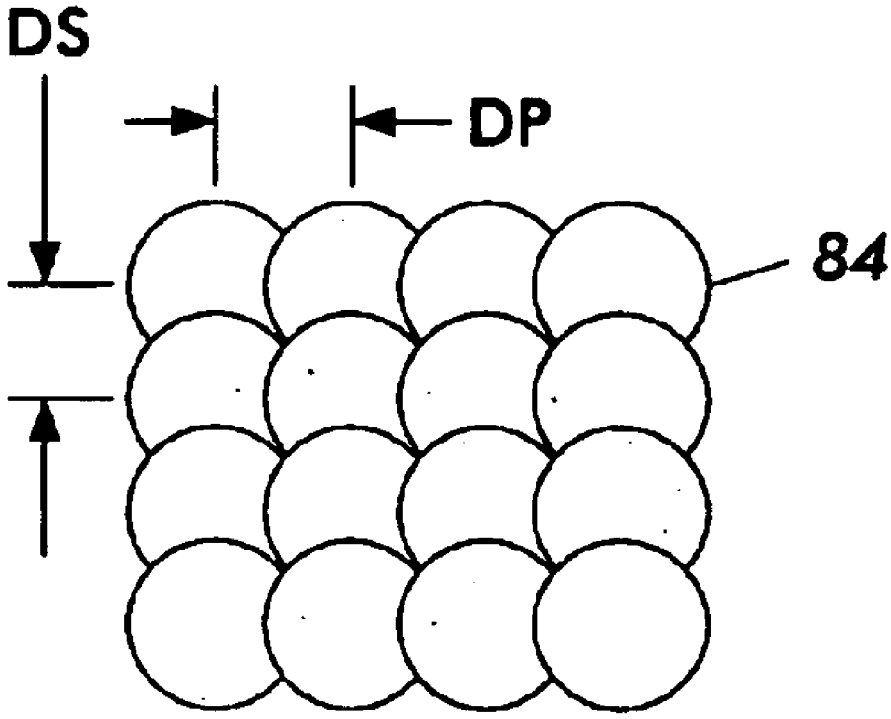
FIG. 12 is a conceptual illustration of a pattern of dots deposited by a printer with a printhead having the ink outlets shown in FIG. 9 arranged at a high density.

FIGS. 10, 11, and 12 show ink dot patterns representative of those deposited by printhead having a single orifice for each ink outlet. Referring to FIG. 10, the single orifice ink outlet ejects ink drops as it moves in the printing direction. These ink drops form ink dots having a printing direction dot spacing DP in the printing direction, and a transverse direction dot spacing DS. In the example shown in FIG. 10, the printing direction dot spacing DP and a transverse direction dot spacing DS are the same. For example, the printing dot spacing DP and the transverse direction dot spacing DS is 1/360 in (70.5 um) to produce an image ink dot density of 360 DPI by 360 DPI. For such exemplary dot spacing, each drop of ink must contain sufficient ink that the ink dots overlap, so that essentially no print medium is exposed between dots. For certain applications, ink drops of approximately 40 picoliters are appropriate. A printhead can eject from each ink outlet orifice approximately 8,000 to 10,000 such drops per second. Ink drops of such size tend to spread on the media. In certain cases, such drops form dots that have a diameter of approximately 115 um. This effect sometimes creates indistinct edges to printed images.

Referring to FIG. 11, the single ink outlet is activated more frequently to produce a smaller dot spacing DP in the printing direction. For example, the printing speed and ink drop ejection rate are controlled to produce a printing direction dot spacing DP smaller than the transverse direction dot spacing DS. In particular, the printing direction dot spacing DP is approximately one half the transverse direction dot spacing DS, so that the dot density in the printing direction is approximately twice the dot density in the transverse direction. Only half as much data is required to control the dot placement in the transverse direction as in the printing direction. However, a relatively large ink drop is required to ensure complete ink coverage of the print medium. For example, for a printing direction dot spacing DP of 1/720 (35.2 um) to produce a dot density of 720 DPI, and a transverse dot spacing DS of 1/360 (70.5 um) to produce a dot density of 360 DPI, the ink drop may be 20–30 picoliters. Such ink drops can be ejected from a single orifice at a maximum rate of approximately 12,000–15,000 drops per second. Such ink drops produce ink dots on the print medium having diameters of approximately 80 um. Properly controlling the combination of the drop ejection rate and the printhead travel speed in the printing direction provides the proper ink dot spacing.

FIG. 12 shows an array of ink dots in which the printing direction dot spacing DP is the same as the transverse direction dot spacing DS. The ink dot spacing is smaller than the ink dot spacing of the array of FIG. 10. In particular, the ink dot spacing of the array of FIG. 12 is approximately half the ink dot spacing of the array of FIG. 10. For example, the printing direction ink dot spacing DP and the transverse ink dot spacing DS can both be approximately 1/1720 in (35.2 um), producing a dot density of approximately 720 DPI in both directions. If each ink outlet produces ink drops of approximately 12 picoliters, each ink outlet can be activated approximately 16,000–20,000 times per second. A separate activation signal is required for each ink outlet. Therefore, for the array of FIG. 12 to cover the same area as the array of FIG. 10 requires four times as many activation signals.

Those skilled in the art will recognize that various modifications can be made to the device described above without departing from the spirit thereof. For example, different numbers of orifices per ink delivery channel may be used, as can different arrangements of the ink orifices or ink outlets through the orifice plate, and different arrangements of the ink delivery channels. In addition, the particular implementation described above pertains to a printer with a moveable printhead 40 that traverses the width of the print medium 32 in the printing direction to print a band of the image. The principles described can also be applied to a printer in which the printhead 40 extends across the full width of the print medium. The printhead remains stationary as the print medium moves in the media travel direction 33 past the printhead as the printhead deposits ink drop sets onto the print medium. In such an implementation, the printing direction 46 is the same as the media travel direction 33, and the printing direction and the media travel direction are not perpendicular one another. The transverse direction 34 of the printhead is transverse to both the printing direction 46 and the media travel direction. Therefore, the present invention is not to be limited to the particular implementation described above.

I claim:

1. An ink jet printer for printing an ink image onto a print medium, the ink jet printer comprising:

a printhead;

a media transport for moving the print medium past the printhead;

a controller for causing the printhead to deposit onto the print medium ink drop sets;

wherein:

the printhead and the print medium move relative to one another in a printing direction, substantially perpendicular to a transverse direction;

each ink drop set comprises at least two drops ejected simultaneously from the printhead;

the two drops of each drop set are offset from one another in the transverse direction by a transverse direction dot offset;

the two drops of each drop set are offset from one another in the printing direction by a printing direction dot offset;

the controller causes the printhead to deposit the ink drop sets with a printing direction dot set spacing between ink drop sets in the printing direction, and a transverse direction dot set spacing between ink drop sets in the transverse direction;

the printing direction dot offset is no greater than the printing direction dot set spacing; and the transverse direction dot set spacing is greater than the printing direction dot set spacing.

2. The ink jet printer of claim 1, wherein:

the transverse direction spacing is twice the printing direction spacing.

3. The ink jet printer of claim 2, wherein the transverse direction dot set spacing is greater than the transverse direction dot offset.

4. The ink jet printer of claim 3, wherein the transverse direction dot set spacing is twice the transverse direction dot offset.

5. The ink jet printer of claim 1, wherein the printhead comprises:

a plurality of ink delivery channels;

a plurality of ink outlets, wherein:

each of the ink outlets corresponds to one of the ink delivery channels;

each of the ink outlets comprises first and second ink orifices;

the first and second ink orifices of each ink outlet are offset from one another in the transverse direction;

a plurality of ink ejectors, wherein:

each of the ink ejectors is individually addressable with a driving signal; and in response to a driving signal, each of the ink ejectors causes the first and second ink orifices of a corresponding ink outlet to eject simultaneously first and second ink drops from one of the ink delivery channels.

6. The ink jet printer of claim 5, wherein the first and second ink orifices of each ink outlet are additionally offset from one another in the printing direction.

7. The ink jet printer of claim 6, additionally comprising:

a plurality of second ink delivery channels;

a plurality of second ink outlets, wherein:

the second ink outlets are offset from the first ink outlets in the printing direction;

each of the second ink outlets corresponds to one of the second ink delivery channels;

each of the ink outlets comprises first and second ink orifices;

the first and second ink orifices of each second ink outlet are offset from one another in the transverse direction;

a plurality of second ink ejectors, wherein:

each of the second ink ejectors causes the first and second ink orifices of a corresponding second ink outlet to eject simultaneously first and second ink drops from one of the second ink delivery channels.

8. The ink jet printer of claim 7, wherein:

each of the second ink outlets is offset in the transverse direction from a corresponding one of the first ink outlets.

9. The ink jet printer of claim 8, wherein:

the first ink outlets are arranged substantially in a first line in the transverse direction; and the second ink outlets are arranged substantially in a second line substantially parallel the first line.

10. The ink jet printer of claim 1, wherein:

the printhead moves in the printing direction; and the media transport moves the print medium in a media travel direction that is substantially the same as the transverse direction.

11. The ink jet printer of claim 1, wherein:

the printhead is stationary; and the media transport moves the print medium in the printing direction.

12. The ink jet printer of claim 1, wherein:

the printhead comprises a plurality of ink outlets;

the printhead additionally comprises a plurality of ink ejectors, wherein each ink ejector is associated with a single one of the ink outlets; and in response to a driving signal, an ink ejector causes one of the ink drop sets to be ejected from its associated ink outlet and deposited onto the print medium.

13. A printhead for an ink jet printer, the printhead comprising:

a printhead body having a printing direction and a transverse direction, a plurality of ink delivery channels;

a plurality of ink outlets, wherein:

each ink outlet comprises an outlet from a corresponding particular one of the ink delivery channels;

each ink outlet comprises first and second ink orifices;

the second ink orifice of each ink outlet is offset in the transverse direction from the first ink orifice of that ink outlet; and a plurality of ink ejectors, wherein each ink ejector simultaneously ejects from the first and second ink orifices of a corresponding particular ink outlet first and second ink drops;

wherein the ink outlets are spaced in the transverse direction by a transverse outlet spacing;

wherein the second ink orifice of each ink outlet is offset from the first ink orifice of that ink outlet in the transverse direction by a transverse orifice offset;

wherein the transverse outlet spacing is greater than the transverse orifice offset; and wherein the transverse outlet spacing is twice the transverse orifice offset.

14. A printhead for an ink jet printer, the printhead comprising:

a printhead body having a printing direction and a transverse direction, a plurality of ink delivery channels;

a plurality of ink outlets, wherein:

each ink outlet comprises an outlet from a corresponding particular one of the ink delivery channels;

each ink outlet comprises first and second ink orifices;

the second ink orifice of each ink outlet is offset in the transverse direction from the first ink orifice of that ink outlet by a transverse orifice offset;

the second ink orifice of each ink outlet is offset in the printing direction from the first ink orifice of that ink outlet by a printing orifice offset;

the transverse orifice offset is approximately twice the printing orifice offset;

the ink outlets are spaced in the transverse direction by a transverse outlet spacing;

the transverse outlet spacing is approximately twice the transverse orifice offset; and a plurality of ink ejectors, wherein each ink ejector simultaneously ejects from the first and second ink orifices of a corresponding particular ink outlet first and second ink drops.

15. A method of using an ink jet printer to print an image, the method comprising:

moving an ink jet printhead in a printing direction past a print medium;

depositing a plurality of first ink drop sets onto the print medium to form a plurality of first ink dot sets having a travel direction spacing between adjacent first ink drop sets; and depositing a plurality of second ink drop sets onto the print medium to form a plurality of second ink dot sets having the travel direction spacing between adjacent second ink drop sets;

wherein:

depositing each first ink dot set comprises simultaneously depositing a first pair of ink dots that are offset from one another in a transverse direction by a transverse dot offset, and offset from one another in the printing direction by a travel direction offset;

depositing each second ink dot set comprises simultaneously depositing a second pair of ink dots that are offset from one another in the transverse direction by a transverse dot offset, and offset from one another in the printing direction by a travel direction offset;

depositing the second ink dot sets comprises depositing second ink dot sets spaced in the transverse direction, substantially perpendicular to the printing direction, from the first ink dot sets by a transverse dot set spacing that is greater than the transverse dot offset;

depositing the plurality of first ink dot sets comprises depositing first ink dot sets spaced in the printing direction by a travel direction dot set spacing; and depositing the plurality of second ink dot sets comprises depositing second ink dot sets spaced in the printing direction by the travel direction dot set spacing.

16. The method of claim 15, wherein the transverse drop set spacing is approximately twice the travel direction drop set spacing.

17. The method of claim 16, wherein the travel direction drop set spacing is approximately twice the travel direction drop offset.

18. The method of claim 17, wherein:

depositing each first ink dot set additionally comprises issuing only a first single control signal to the first ink outlet for each first ink dot set; and depositing each second ink dot set additionally comprises issuing only a second single control signal to the second ink outlet for each second ink dot set.

19. An ink jet printer for printing an ink image onto a print medium, the ink jet printer comprising:

an ink jet printhead having a plurality of ink outlets and a plurality of ink ejectors;

wherein each ink ejector is associated with a single corresponding single one of the ink outlets;

a print moving mechanism for moving the printhead and the print medium relative to one another in a printing direction; and a controller for selectively activating the ink ejectors;

wherein when an ink ejector is activated, the ink ejector simultaneously ejects an ink drop set comprising a pair of ink drops from the corresponding ink outlet toward the print medium;

wherein the ink drops of each ink drop set are offset from one another in a transverse direction, substantially perpendicular to the printing direction, by a transverse dot offset;

wherein the controller activates a selected ink ejector to sequentially eject an initial ink drop set and a subsequent ink drop set spaced from one another in the printing direction by a printing direction dot set spacing; and wherein the transverse dot set spacing is greater than the printing direction dot set spacing.

20. The ink jet printer of claim 19, wherein the transverse dot set spacing is approximately twice the printing direction dot set spacing.

21. A method of printing an image on a print medium, the method comprising:

moving the print medium and an ink jet printhead relative to one another in a travel direction;

using a single control signal to eject from a first ink outlet of the printhead a first ink drop set toward a print medium;

wherein ejecting from the first ink outlet a first ink drop set comprises simultaneously ejecting a first pair of ink drops that are offset from one another in the travel direction and in a transverse direction substantially perpendicular to the travel direction;

using a separate single control signal to eject from a second ink outlet of the printhead a second ink drop set toward the print medium;

wherein ejecting from the second ink outlet a second ink drop set comprises simultaneously ejecting a second pair of ink drops that are offset from one another in the travel direction and in the transverse direction;

wherein ejecting the second ink drop set comprises ejecting the second ink drop set spaced from the first ink drop set by a transverse drop set spacing;

after ejecting the first and second ink drop sets, moving the print medium and the ink jet printhead relative to one another a travel direction drop set spacing in the travel direction;

subsequently ejecting from the first ink outlet a subsequent first ink drop set;

wherein subsequently ejecting the subsequent first ink drop set comprises simultaneously ejecting a subsequent first pair of ink drops that are offset from one another in the travel direction and in a transverse direction;

subsequently ejecting from the second ink outlet a subsequent second ink drop set;

wherein subsequently ejecting the subsequent second ink drop set comprises simultaneously ejecting a subsequent second pair of ink drops that are offset from one another in the travel direction and in a transverse direction; and wherein the travel direction drop set spacing is less than the transverse drop set spacing.

22. The method of claim 21, wherein the travel direction drop set spacing is approximately twice the travel direction drop offset.

23. The method of claim 21, wherein the transverse drop set spacing is approximately twice the travel direction drop set spacing.

24. The method of claim 21, wherein:

the ink drops of the first pair of ink drops are offset from one another in the travel direction by a travel direction drop offset;

the ink drops of the second pair of ink drops are offset from one another in the travel direction by the travel direction drop offset; and the travel direction drop offset is less than the travel direction drop set spacing.

* * * * *